US005879635A

United States Patent [19]

Nason

[11] Patent Number: 5,879,635

[45] Date of Patent: Mar. 9, 1999

[54] REAGENT DISPENSER AND RELATED TEST KIT FOR BIOLOGICAL SPECIMENS

[76] Inventor: Frederic L. Nason, 941 Avenida Acaso, Camarillo, Calif. 93010

[21] Appl. No.: 829,248

[22] Filed: Mar. 31, 1997

[51] Int. Cl.[6] ..... B01L 3/00

[52] U.S. Cl. ..... 422/102; 206/209; 422/61; 422/58; 422/100; 422/104; 436/174; 436/180

[58] Field of Search ..... 422/61, 58, 81, 422/100, 102, 104; 436/174, 180; 206/209

[56] References Cited

U.S. PATENT DOCUMENTS

| | | |
|---|---|---|
| D. 369,214 | 4/1996 | Nason . |
| 2,490,168 | 12/1949 | Strauss . |
| 2,510,490 | 6/1950 | Ager . |
| 3,004,681 | 10/1961 | Jinkens . |
| 3,163,160 | 12/1964 | Cohen . |
| 3,324,855 | 6/1967 | Heimlich . |
| 3,450,129 | 6/1969 | Avery et al. . |
| 3,495,917 | 2/1970 | Truhan . |
| 3,640,268 | 2/1972 | Davis . |
| 3,674,007 | 7/1972 | Freis . |
| 3,773,035 | 11/1973 | Arnoff . |
| 3,776,220 | 12/1973 | Monaghan . |
| 3,792,699 | 2/1974 | Tobin . |
| 3,883,396 | 5/1975 | Thomas, Jr. . |
| 3,890,204 | 6/1975 | Avery . |
| 3,890,954 | 6/1975 | Greenspan . |
| 3,913,564 | 10/1975 | Freshley . |
| 3,915,806 | 10/1975 | Horlach . |
| 3,918,435 | 11/1975 | Beall et al. . |
| 3,923,604 | 12/1975 | Monaghan . |
| 3,954,563 | 5/1976 | Mennen . |
| 3,958,571 | 5/1976 | Bennington . |
| 4,014,746 | 3/1977 | Greenspan . |
| 4,014,748 | 3/1977 | Spinner et al. . |
| 4,059,404 | 11/1977 | Schuster et al. . |
| 4,175,008 | 11/1979 | White . |
| 4,184,483 | 1/1980 | Greenspan . |
| 4,196,167 | 4/1980 | Olsen . |
| 4,223,093 | 9/1980 | Newman . |
| 4,300,910 | 11/1981 | Pannwitz . |
| 4,311,792 | 1/1982 | Avery . |
| 4,312,950 | 1/1982 | Snyder . |
| 4,340,670 | 7/1982 | Mennen . |
| 4,353,868 | 10/1982 | Joslin . |
| 4,355,113 | 10/1982 | Mennen . |
| 4,387,725 | 6/1983 | Mull . |
| 4,409,988 | 10/1983 | Greenspan . |
| 4,562,043 | 12/1985 | Mennen . |
| 4,586,604 | 5/1986 | Alter . |
| 4,635,488 | 1/1987 | Kremer . |
| 4,653,510 | 3/1987 | Koll . |
| 4,707,540 | 11/1987 | Nason . |
| 4,770,853 | 9/1988 | Bernstein . |
| 4,790,640 | 12/1988 | Nason . |
| 4,813,432 | 3/1989 | Saint-Amand . |
| 4,978,504 | 12/1990 | Nason . |
| 5,078,968 | 1/1992 | Nason . |
| 5,238,649 | 8/1993 | Nason . |
| 5,266,266 | 11/1993 | Nason . |
| 5,425,920 | 6/1995 | Conti et al. ..... 422/102 |
| 5,449,494 | 9/1995 | Seeney ..... 422/102 |

FOREIGN PATENT DOCUMENTS

| | | |
|---|---|---|
| 0058008 | 8/1982 | European Pat. Off. . |
| 0155747 | 9/1995 | European Pat. Off. . |

*Primary Examiner*—Krisanne Thornton
*Attorney, Agent, or Firm*—Kelly Bauersfeld Lowry & Kelley, LLP

[57] ABSTRACT

A reagent dispenser is provided for dispensing multiple reagents particularly for use in analyzing biological specimens and the like. The dispenser includes a pair of reagent chambers with selected reagents therein, and a dual nib for hermetically sealing the reagent chambers. A portion of the dispenser is deformable to break or otherwise to displace the nib in a manner permitting the two reagents to flow together and mix within one of the reagent chambers. The deformable portion or the dispenser can then be squeezed to express the mixed reagents for delivery to contact a specimen to be analyzed. In a preferred form, the dispenser is cap assembly for removable mounting onto an open-ended tubular housing to cooperatively define a specimen chamber within the housing for receiving the specimen on a swab or the like.

48 Claims, 11 Drawing Sheets

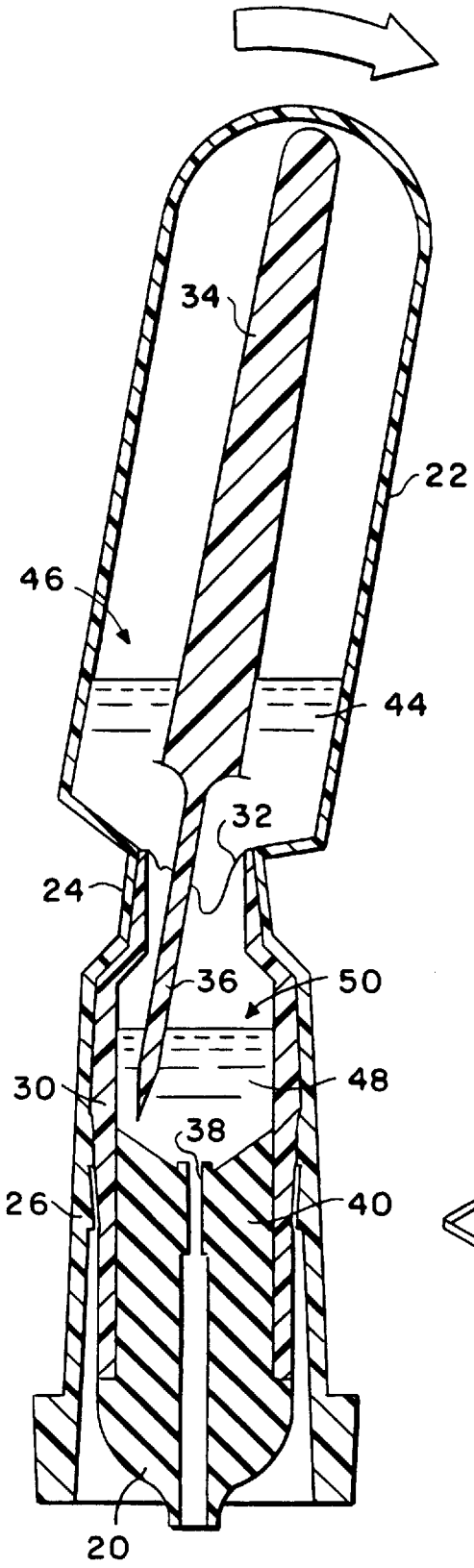
FIG. 3
FIG. 4
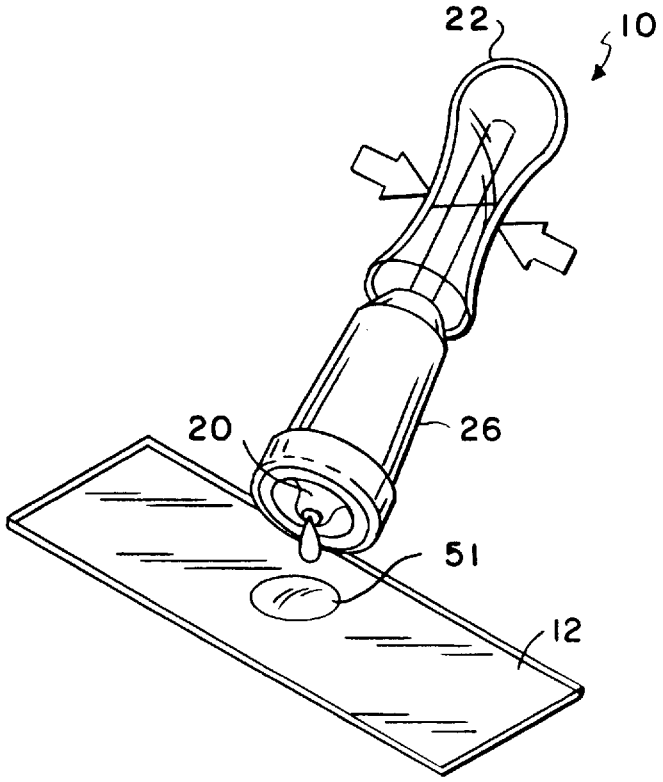

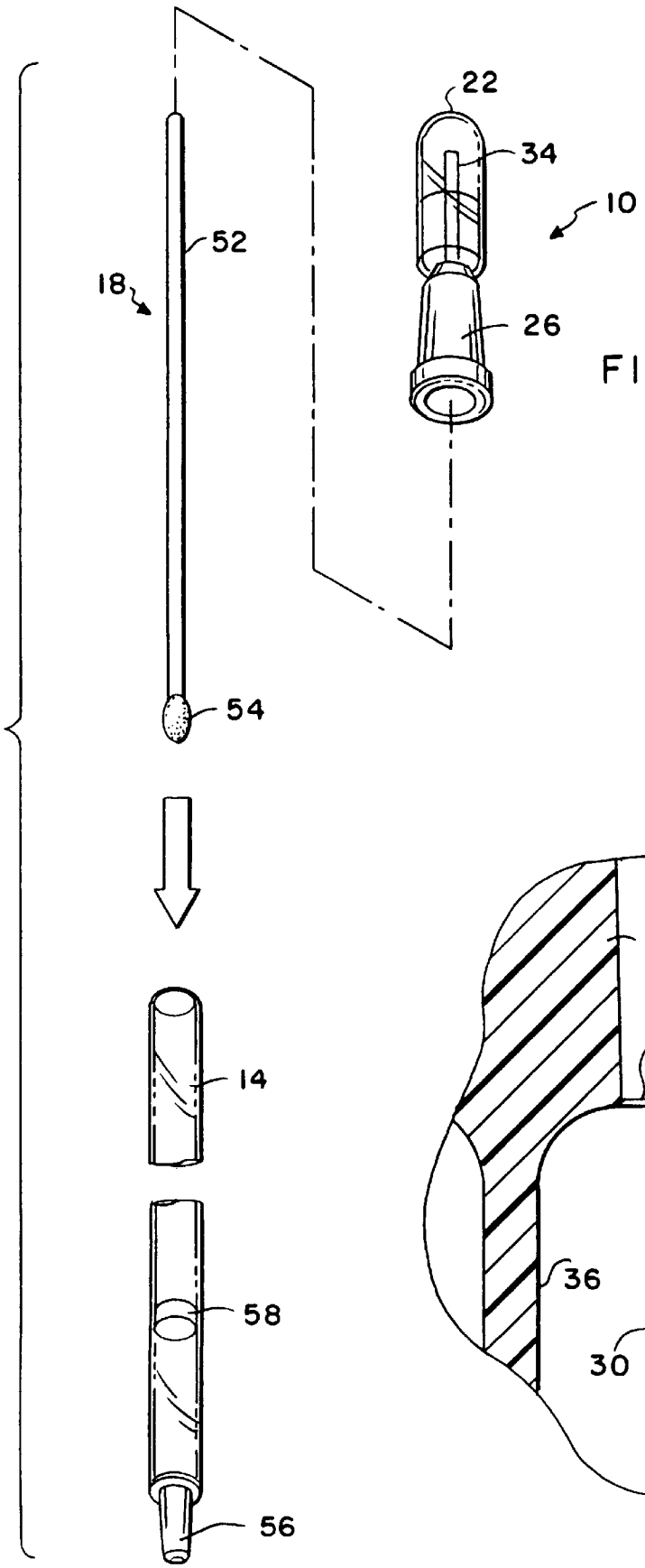
FIG. 8
FIG. 7
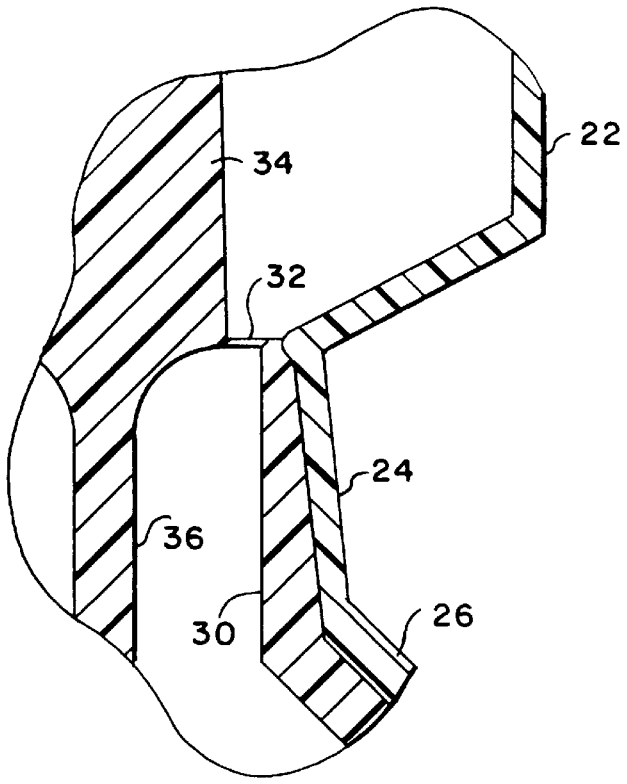

REAGENT DISPENSER AND RELATED TEST KIT FOR BIOLOGICAL SPECIMENS

BACKGROUND OF THE INVENTION

This invention relates generally to improvements in medical test devices and kits used for collecting and analyzing biological specimens. More particularly, this invention relates to an improved reagent dispenser and related test kit of the general type described in U.S. Pat. No. 5,266,266, with means for mixing and delivering multiple reagents for contact with a biological specimen in the course of performing a medical analysis or the like.

Medical swabs are generally known in the art for use in collecting biological specimens from a patient for further analysis. Such medical swabs commonly comprise a fibrous swab tip at one end of an elongated stick or shaft which is manually handled to contact the swab tip with selected tissue cells or other biological specimen obtained, for example, within the ear, nose or throat of a patient. As a result, some of the targeted biological specimen adheres to the swab tip which then can be contacted with one or more chemical reagents to indicate the presence of infection or other information regarding patient condition. Tests commonly performed with such patient specimens include, by way of example, fluorescent tests, enzymatic tests, monoclonal based tests, agglutination tests, and others.

In accordance with standard specimen collection and test preparation techniques, the biological specimen is normally transferred from the swab tip to a slide or other laboratory apparatus such as a test tube or the like for contact with the selected reagent and further analysis. However, it is frequently difficult to ensure transfer of a sufficient specimen quantity from the swab tip to the laboratory slide or test tube to ensure accurate test results. Moreover, in many instances, the collected specimen must be transported to an off-site medical laboratory for performance of selected assays, but delays between the time of specimen collection and actual test performance can result in partial or complete drying of the specimen, with a corresponding decrease in test reliability.

Various swab-type collection and test devices have been proposed in efforts to provide enhanced contact between a specimen and reagent, or, in the alternative, to sustain the specimen for post-collection transport to a medical laboratory. Such swab collection devices have been provided in the form of a compact kit including a fibrous-tipped swab together with one or more reagents for contacting a specimen collected on the swab tip. In some designs, the reagent is sealed within a frangible glass ampoule which is broken at the appropriate time to release the reagent for contacting the specimen on the swab tip. See, for example, U.S. Pat. Nos. 4,792,699; 4,978,504; 5,078,968; and 5,238,649. The glass ampoule, however, comprises an additional and relatively costly component to the collection device or kit. Moreover, the glass ampoule produces sharp fragments or shards when broken, wherein the collection device must be designed to prevent the glass fragments from contacting the collected specimen or medical personnel.

Alternative swab-type collection devices have envisioned reagent placement within a rupturable cell or compartment formed within a plastic swab housing. See, for example, U.S. Pat. No. 4,707,450. In these designs, the reagent cell or compartment is opened at the appropriate time to permit reagent release for flow into contact with a collected specimen on the swab tip. While this approach avoids the disadvantages associated with glass ampoules, the manufacture of plastic housings with liquid-filled compartments adapted for controlled rupture has been relatively difficult and generally unreliable.

U.S. Pat. No. 5,266,266 discloses a further improved swab-type specimen test device, wherein a reagent is contained within a sealed compartment which is opened at the appropriate time by manipulating a break-off nib. This device beneficially avoids the use of glass ampoules and further provides for reliable and controlled reagent release in a cost-efficient design.

For some specimen analyses, it is necessary or desirable to mix multiple reagents together prior to contacting the specimen, wherein the mixed reagents are sufficiently unstable to require that they be maintained in separate sealed chambers until the test is to be performed. Prior swab-type specimen test devices have not satisfactorily addressed such applications.

The present invention is directed to an improved reagent dispenser device, particularly of the type having a break-off nib, for maintaining multiple reagents in separate chambers for convenient mixing and delivery at the appropriate time to contact a collected specimen.

SUMMARY OF THE INVENTION

In accordance with the invention, a dispenser is provided for mixing and delivering two or more reagents or the like, particularly for use in contacting a biological specimen in the course of performing a medical analysis. The reagent dispenser includes a housing defining multiple chambers for respectively receiving and storing multiple reagents in hermetically sealed relation. The reagent chambers are separated by a closure means configured to open in response to deformation of a portion of the housing to permit the reagents to flow together for delivery through an outlet port for contacting a biological specimen or the like.

In one preferred form, the reagent dispenser is provided for testing and analyzing biological specimens, and is provided in the form of a cap assembly for mounting onto an open-ended tubular housing in a manner cooperatively defining a specimen chamber within said housing for receiving a biological specimen or the like, for example, on the tip of a swab placed into the specimen chamber. A portion of the cap assembly is sufficiently deformable to permit manipulation of the closure means in the form of a break-off nib contained therein for the purpose of breaking the seal between a pair of reagent chambers having different reagents stored therein. In the preferred form, the break-off nib additionally carries a stem pin which normally closes the outlet port. Manipulation of the nib to break the seal between the reagent chambers permits the reagents to flow together and mix within one of the reagent chambers. Subsequent or concurrent deformation of the cap assembly withdraws or otherwise displaces the stem pin relative to the outlet port to open said outlet port and permit delivery of the mixed reagents to the specimen chamber, for example, by squeezing the deformable portion of the cap assembly to express the mixed reagents through the outlet port.

The nib can be designed to break the seal between the reagent chambers substantially concurrently with displacement of the stem pin to open the outlet port, or these actions can occur in sequence to ensure reagent mixing prior to outflow passage through the outlet port. Alternatively, the outlet port may be defined by a porous filter element which prevents passage of liquid reagent therethrough, unless the dispenser is sufficiently deformed as by squeezing for pressure-expression of the mixed reagents through the porous filter.

Other features and advantages of the present invention will become more apparent from the following detailed description, taken in conjunction with accompanying drawings which illustrate, by way of example, the principles of the invention.

BRIEF DESCRIPTION OF THE DRAWINGS

The accompanying drawings illustrate the invention. In such drawings:

FIG. 3 is an enlarged fragmented sectional view similar to FIG. 2, but illustrating deformation of the dispenser to sever a break-off nib;

FIG. 4 is a perspective view of the dispenser of FIGS. 1–3, and illustrating further deformation of the dispenser to express mixed reagents for contacting a biological specimen or the like;

FIG. 7 is a further enlarged sectional view corresponding generally with the encircled region 7 of FIG. 6;

FIG. 8 is a fragmented exploded perspective view illustrating assembly of the components forming the test kit depicted in FIG. 5;

DETAILED DESCRIPTION OF THE PREFERRED EMBODIMENTS

Figure 1:
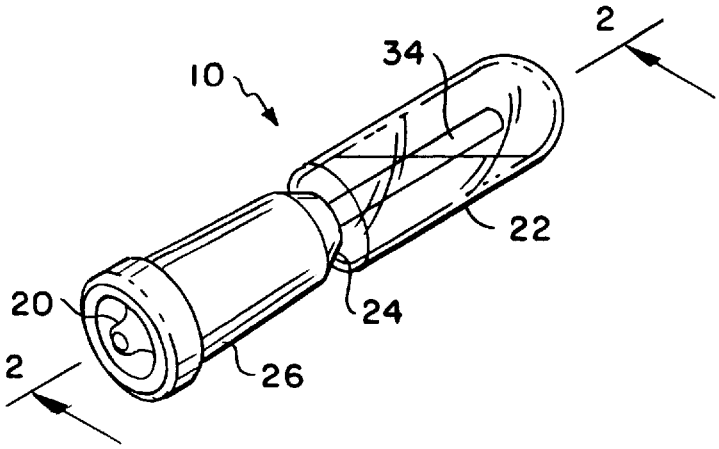
FIG. 1 is a perspective view illustrating one preferred construction for a reagent dispenser embodying the novel features of the invention.

As shown in the exemplary drawings, an improved reagent dispenser referred to generally in FIGS. 1–4 by the reference numeral 10 is provided particularly for use in analyzing and testing biological specimens. The dispenser 10 carries multiple reagents in liquid or dry form in separate sealed chambers, and the dispenser is adapted for quick and easy manipulation to mix the reagents and then to deliver the mixed reagents to a test site, such as to contact a specimen for analysis. The specimen can be located on a suitable substrate, such as a glass slide 12 depicted in FIG. 4. Alternately, the dispenser 10 can be provided in the form of a cap assembly as shown, for example, in FIGS. 5–10, mounted on an open-ended tubular housing 14 to define a specimen chamber 16 for receiving the specimen on a swab 18 or the like. In the latter case, the dispenser 10 cooperates with the housing 14 to form an integrated test kit and functions to deliver the multiple reagents to contact the specimen within the specimen chamber 16.

The dispenser 10 of the present invention is particularly useful in performing medical analyses on biological specimens in the form of tissue or cells which have been collected and transferred to an appropriate test site. In this regard, a conventional swab or scraper or the like is commonly used by medical personnel to collect a target specimen from a patient. The specimen is then transferred to a suitable test site substrate such as the laboratory slide 12 depicted in FIG. 4 for subsequent contact by the appropriate reagents to perform the desired analysis. A broad range of medical assays are performed in this manner, including fluorescent tests, enzymatic tests, monoclonal tests, agglutination tests, and others.

The dispenser 10 of the present invention comprises a compact and cost-efficient hollow housing with an internal partition subdividing an internal volume into a multichambered structure for containing and storing the multiple reagents in hermetically sealed relation to each other. In this regard, the multiple reagents required to perform a variety of medical tests are relatively stable if stored separately, but require mixing before or at the time of delivery to and contact with the target specimen. The mixed reagents, however, may be relatively unstable and thus must be mixed immediately prior to contacting the specimen in order to achieve reliable test results. The dispenser 10 of the present invention effectively and safely stores the multiple reagents in sealed relation while providing a convenient and easily manipulated structure for reagent intermixing and delivery of the mixed reagents to contact the specimen. The entire structure is provided in a convenient and substantially self-contained device which minimizes the handling and exposure of the various test constituents, to thereby achieve improved reliability in the final test results. Moreover, while the invention is described in connection with a preferred environment which involves medical analyses, persons skilled in the art will recognize that the dual chemistry dispenser can be utilized in a broad range of applications wherein it is necessary or desirable to store dual agents in hermetically sealed relation, and to intermix those agents in controlled proportion for prompt dispensing and use.

FIGS. 1–4 illustrate the dispenser 10 in one preferred form for mixing and dispensing dual reagents by means of a dropper tip 20. More specifically, the illustrative dispenser 10 comprises an outer cap 21 of blow molded or injection molded plastic to include an upper deformable squeeze bulb 22 joined integrally by a narrowed neck 24 to a lower mounting sleeve 26. The cap 21 is sufficiently transparent to permit viewing of an internal closure member in the form of a nib unit 28 of injection molded plastic or the like fitted into this outer cap 21, with a cylindrical liner sleeve 30 press-fitted into the cap mounting sleeve 26. The liner sleeve 30 has an upper end which transitions through the neck 24 and is joined integrally by a thin rupturable or frangible membrane ring 32 to a break-off nib 34 which projects upwardly as shown into the interior of the squeeze bulb 22. A central stem pin 36 is provided as an extension of the nib 34 and projects downwardly from the nib 34 within the liner sleeve 30 to engage and sealingly close an outlet port 38 formed in a seal plug 40 pressed into the liner sleeve 30.

Figure 2:
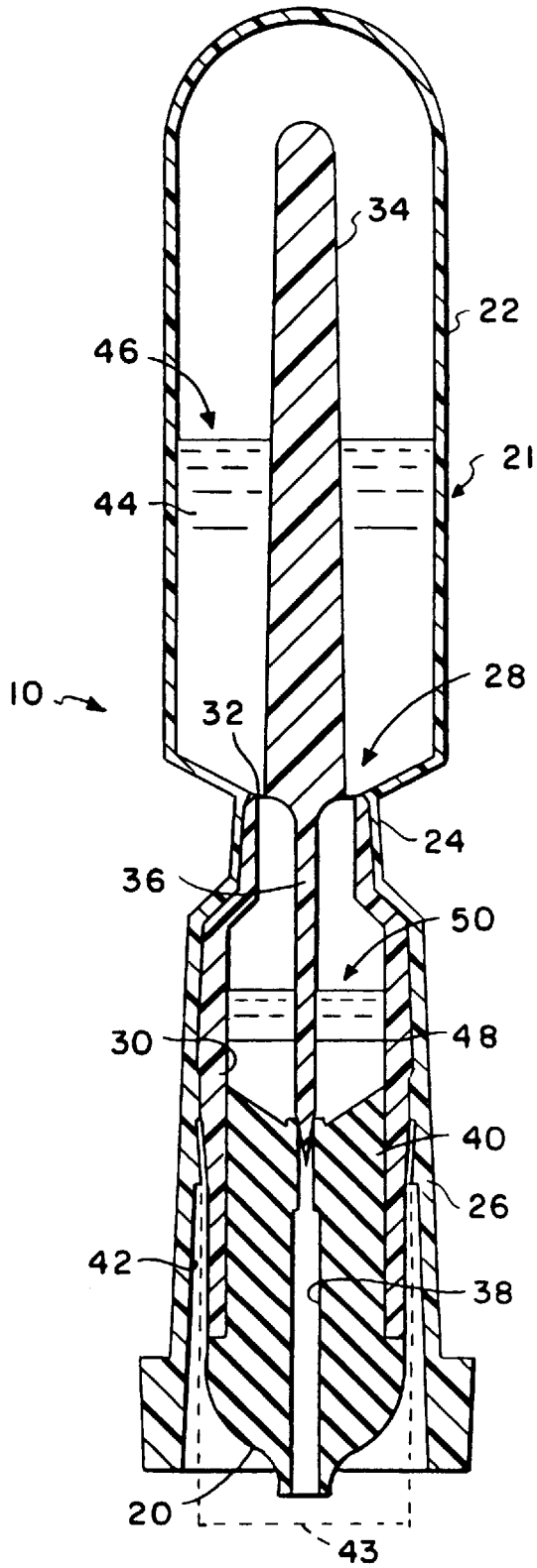
FIG. 2 is an enlarged fragmented vertical sectional view taken generally on the line 2—2 of FIG. 1.
Figure 5:
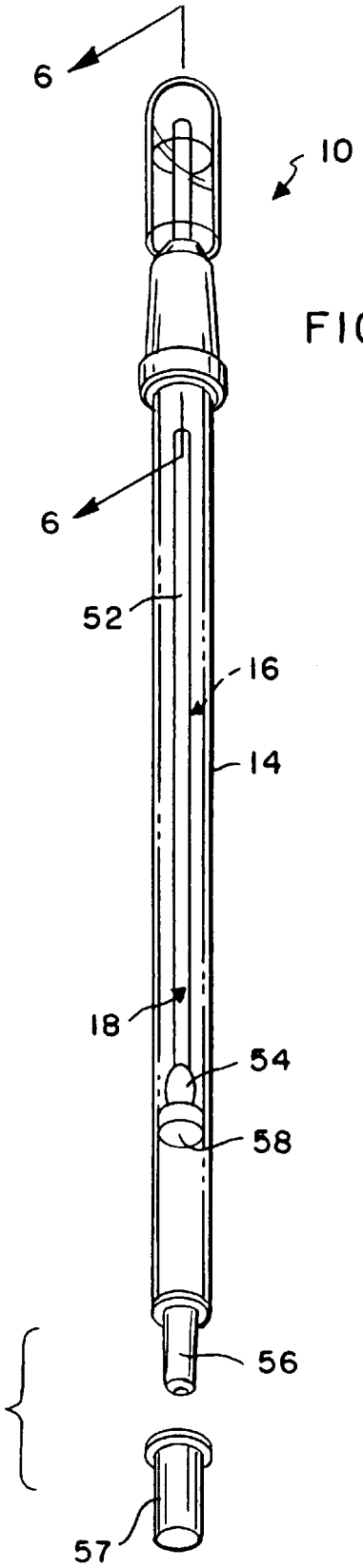
FIG. 5 is an exploded perspective view illustrating the dispenser in combination with an open-ended housing for receiving a specimen, to form an integrated test kit.
Figure 6:
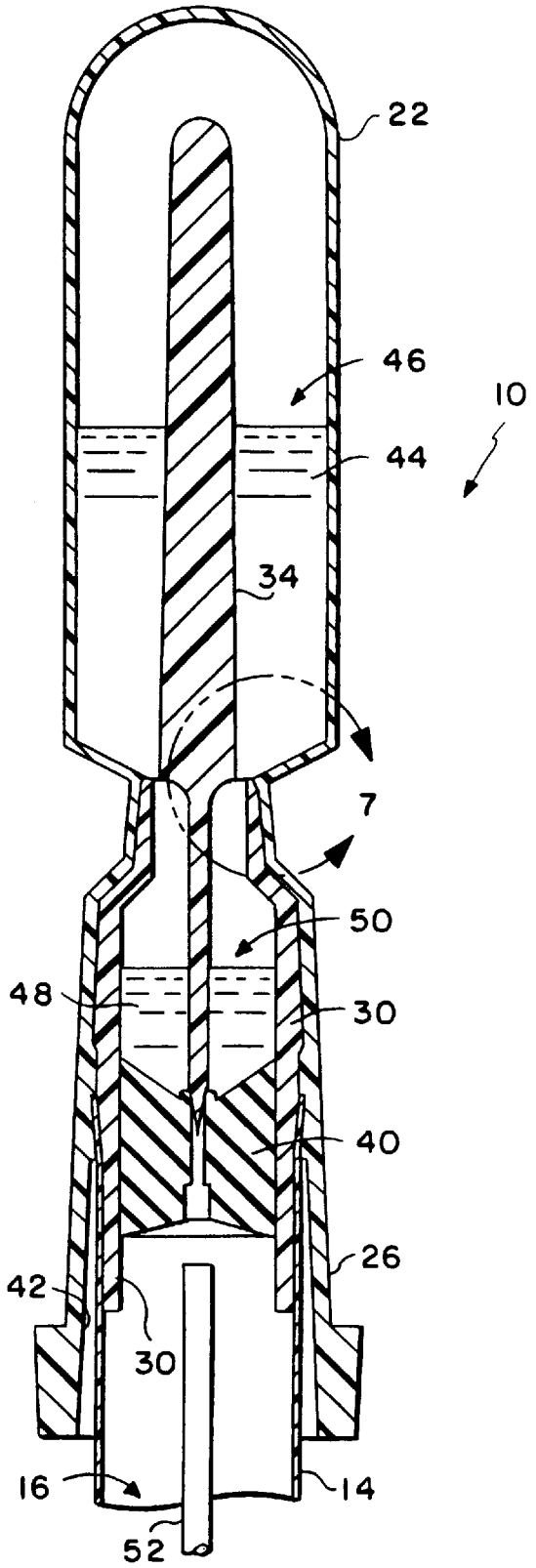
FIG. 6 is an enlarged vertical sectional view taken generally on the line 6—6 of FIG. 5.
Figure 9:
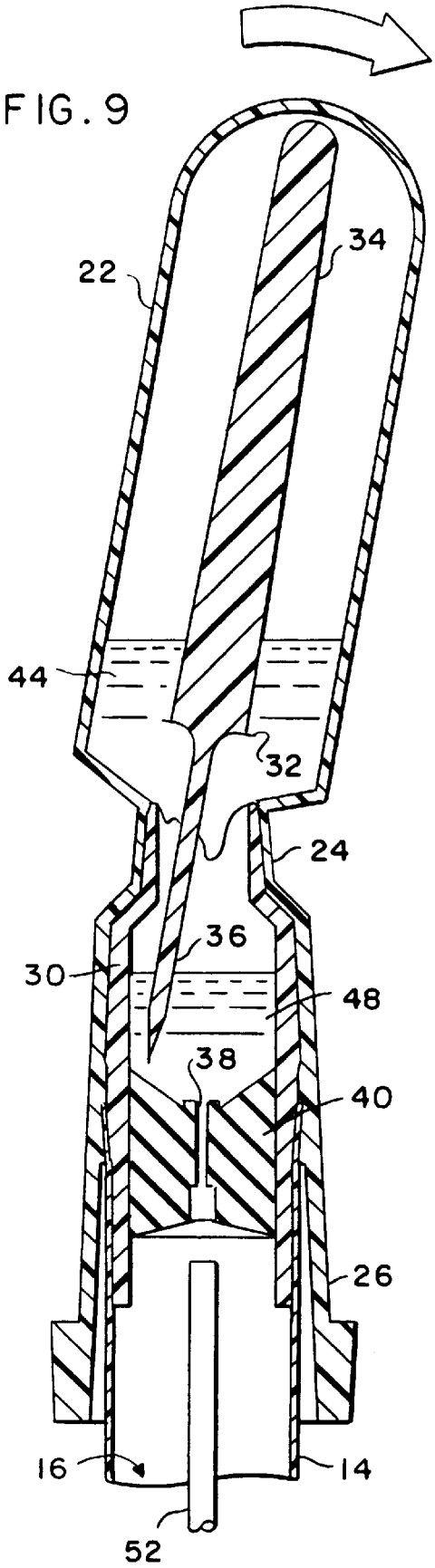
FIG. 9 is an enlarged fragmented vertical sectional view, similar to FIG. 6, but illustrating deformation of the dispenser to sever the break-off nib.
Figure 10:
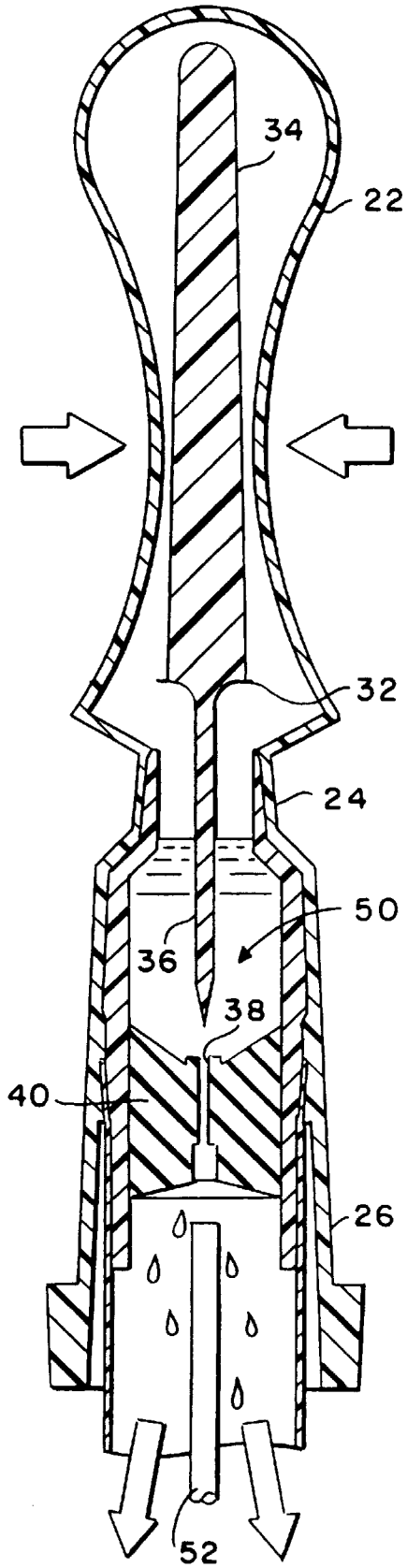
FIG. 10 is an enlarged fragmented vertical sectional view similar to FIG. 9, and illustrating further deformation of the dispenser to express mixed reagents.

The dispenser 10 including the outer cap 21 and the nib unit 28 is assembled in a manner to receive and contain two reagents, shown in liquid form in FIGS. 2 and 3. More specifically, a first reagent 44 is placed into a first chamber 46 defined by the interior volume of the squeeze bulb 22. The nib unit 28 is then pressed-fitted into the outer cap, so that the upper end of the liner sleeve 30 seals through the neck 24, in cooperative relation with the membrane ring 32 and associated nib 34. A second reagent 48 is then placed into the interior of the liner sleeve 30, within a second chamber 50, followed by press-fit placement of the seal plug 40 in a position with the stem pin 36 sealingly closing the plug outlet port 38. This assembly of the dispenser 10 is normally done with the dispenser in an inverted orientation relative to that depicted in FIGS. 2 and 3. In addition, where precision proportioning of dual reagents is desirable, the volumetric quantities of the two reagents 44, 48 may be closely controlled. When assembled, the lower mounting sleeve 26 of the outer cap 21 cooperates with a lower margin of the nib unit liner sleeve 30 to define a downwardly open annulus 42 for receiving and sealingly engaging a cup-shaped lower cap 43, as depicted in dotted lines in FIG. 2. This lower cap 43 thus engages the remainder of the dispenser 10 to provide a normally closed and sealed unit which can be appropriately sanitized.

When it is desired to perform a test, the dispenser 10 is manipulated to allow the two reagents 44, 48 to intermix. In this regard, FIG. 2 shows the squeeze bulb 32 in a normal or nondeformed position, whereas FIG. 3 shows squeeze bulb 22 in a deformed position bent with finger pressure through an angular stroke relative to the lower mounting sleeve 26, resulting in a corresponding bendover displacement of the nib 34 sufficient to rupture the membrane ring 32, and thereby break the seal between the two reagent chambers 46, 50. This allows the first reagent 44 to flow through the passage defined by the cap neck 24 into the second chamber 50, for intermixture with the second reagent 48.

Bendover displacement of the squeeze bulb 22 also functions to displace the stem pin 36 relative to the seal plug outlet port 38, in a manner which pulls the stem pin out of the outlet port. Importantly, the structure of the dispenser 10 can be tailored to provide for substantially simultaneous rupture of the membrane ring 32 and pull-out displacement of the stem pin 36, or these events can be designed to occur in sequence if desired. For example, the dispenser can be designed to rupture the membrane ring 32 when the squeeze bulb 22 and nib 34 are bent through an angle of 30 to 35 degrees, followed by opening of the outlet port 38 when the squeeze bulb 22 and nib 34 are bent subsequently or further through a larger angle, for example, greater than about 45 degrees.

In either case, the mixed reagents within the dispenser 10, primarily within the second chamber 50, are available for convenient and safe dispensing through the outlet port 38 to a suitable test site, by mere squeeze deformation of the squeeze bulb 22, as illustrated in FIG. 4. Such squeeze action pressure-dispenses the mixed reagents through the outlet port 38, a downstream end of which is defined by the dropper tip 20. FIG. 4 illustrates dispensing of the mixed reagents via the dropper tip 20 to contact a specimen 51 on the glass laboratory slide 12. In this regard, the dropper tip 20 may be small enough in size to prevent substantial reagent outflow unless and until the squeeze bulb 22 is actuated for pressure-dispensing of the mixed reagents. It will be understood, however, that the mixed reagents can be dispensed to specimen substrates of other structural forms, and also that the mixed reagents can be dispensed for applications other than medical tests. Moreover, it will be recognized and appreciated that the outlet port 38 may be associated with dispenser means other that the dropper tip 20, such as a foam pad or similar porous structure for swabbing the mixed reagents onto a selected surface, for example, such as the skin of a patient.

FIGS. 5–10 show the dispenser 10 for use in combination with the open-ended tubular housing 14 to form an integrated test kit wherein the multiple reagents are dispensed directly to the specimen chamber 16 defined cooperatively by the dispenser 10 and the housing 14. In this form, the swab 18 is provided as a conventional implement for use in collecting a target specimen. The swab 18 includes an elongated stick or shaft 52 for facilitated manipulation by a doctor or nurse to collect the specimen on a swab tip 54 of cotton fiber or the like. The swab 18, with collected specimen thereon, has a size and shape for quick and easy placement into the specimen chamber 16. The open rear end of the tubular housing 14 is sized for press-fit and substantially seated and sealed engagement with the dispenser 10 by fitting into the annulus 42 defined between the lower mounting sleeve 26 and the internal liner sleeve 30. The opposite or nose end of the tubular housing 14 is shown to include a dropper tip 56 which can be closed and covered by a removable cap 57. A porous filter plug 58 can be press-fitted into the housing 14 at a location near the dropper tip 56, for use in certain test procedures as will be described in more detail.

Subsequent to collection of the target specimen on the swab tip 54, the dispenser 10 can be manipulated as described previously with respect to FIGS. 1–4 to deliver the multiple reagents directly to the specimen chamber 16 to contact the specimen on the swab tip to perform the desired medical test, or step thereof. In one example, the mixed reagents can be allowed to contact the specimen for a finite time period of a few minutes, followed by subsequent pressure-dispensing of the test constituents from the test kit for subsequent analysis. Such dispensing of the test constituents is accomplished quickly and easily by removing the nose cap 57 (FIG. 5) from the dropper tip 56, and then squeezing the squeeze bulb 22 a second time for pressure-caused dispensing of the test constituents through the filter plug 58 and the dropper tip 56. An additional chemical agent can be provided in dried form embedded within the filter plug 58, if desired. Alternately, the tubular housing 14 may be formed from a blow molded material to permit manual deformation to dispense the test constituents.

As one example of use of the test kit shown in FIGS. 5–10, the device can be utilized to perform a strep extraction test. In such application, the test kit provides mixed reagents such as nitric acid that can lyse Strep A cells collected from the throat of a patient on the swab 18. In one form, an acid such as citric or acetic acid is contained within the upper chamber 46 and a nitrite such as sodium nitrite is contained within the lower chamber 50 After the specimen on the swab is placed into the specimen chamber 16, the test kit is manipulated as described above to mix the reagents to form nitric acid which is then delivered to the specimen chamber for contacting the collected cells. The reagent solution is allowed to digest the specimen for a defined holding period, typically about 30–90 seconds. Subsequent delivery of the test constituents through the dropper tip 56 to a diagnostic well (not shown) for reading is accompanied by contacting the test constituents with a neutralizing buffer, such as trishydroxymethylaminomethane (TRIS).

Figure 11:
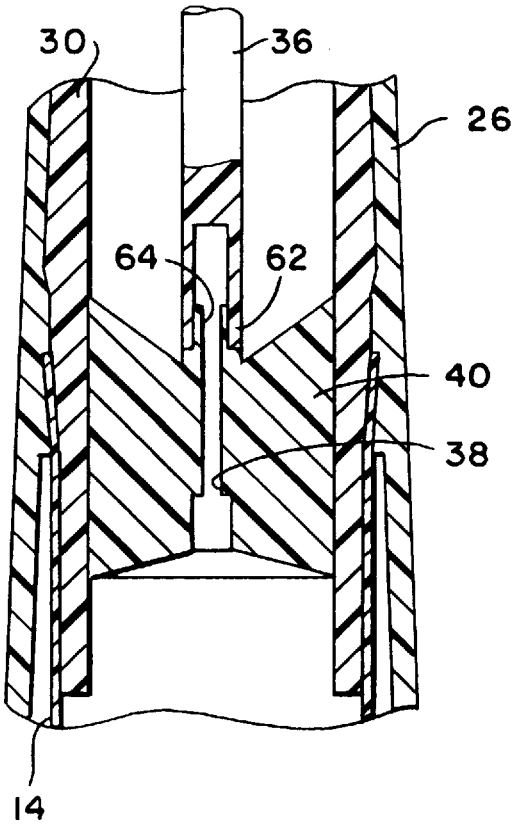
FIG. 11 is an enlarged fragmented vertical sectional view depicting one alternative preferred form of the invention.

FIG. 11 shows an alternative form of the invention, wherein structural components corresponding to those shown and described in FIGS. 1–10 are identified by common reference numerals. In this configuration, the stem pin 36 is modified to include a hollow-ended tip 62 which fits over a cylindrical protrusion 64 at an upstream end of the outlet port 38 in the seal plug 40. The stem pin 36 and seal plug 40 thus interengage for normally sealing the outlet port 38. Bendover displacement of the squeeze bulb 22 and break-off nib 34 (not shown in FIG. 11) as previously described will result in separation of the stem pin tip 62 from the protrusion 64, thereby opening the outlet port 38. Alternately, the components can be designed so that such bendover displacement will break off the protrusion 64 from the seal plug 40 and thereby open the outlet port 38.

Figure 12:
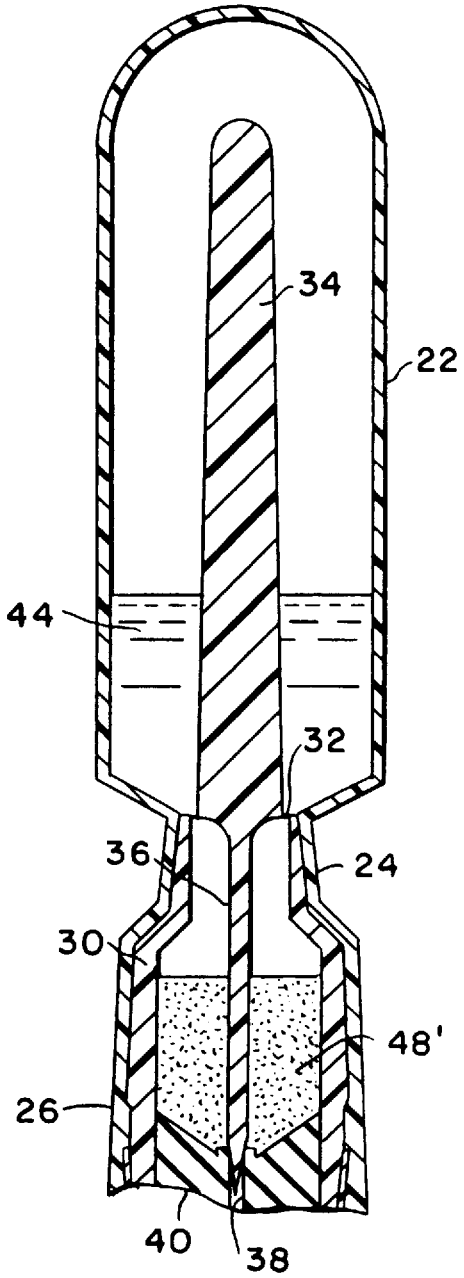
FIG. 12 is an enlarged fragmented vertical sectional view depicting a further alternative preferred form of the invention.

FIG. 12 shows another alternative embodiment, differing from FIGS. 1–10 only with respect to the provision of the second reagent 48' in a dried form, for example, crystalline or powdered form. In this version, bendover displacement of the squeeze bulb 22 and the break-off nib 34 therein again enables the first reagent 44 to mix with the second reagent 48', to provide a mixed solution that can be dispensed subsequently through the outlet port 38, as previously described.

Figure 13:
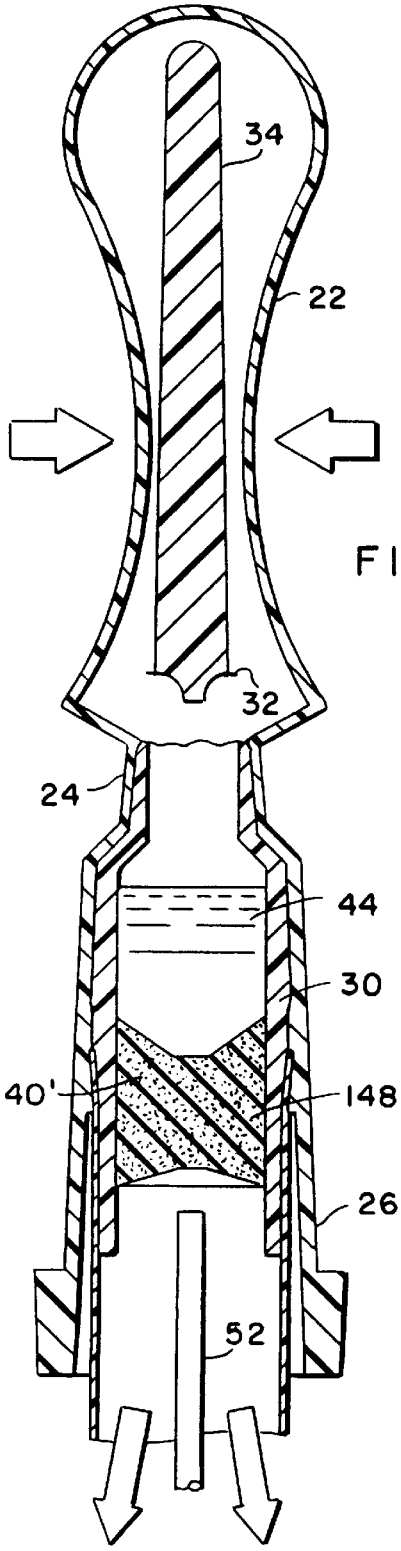
FIG. 13 is an enlarged fragmented vertical sectional view showing still another alternative preferred form of the invention.
Figure 14:
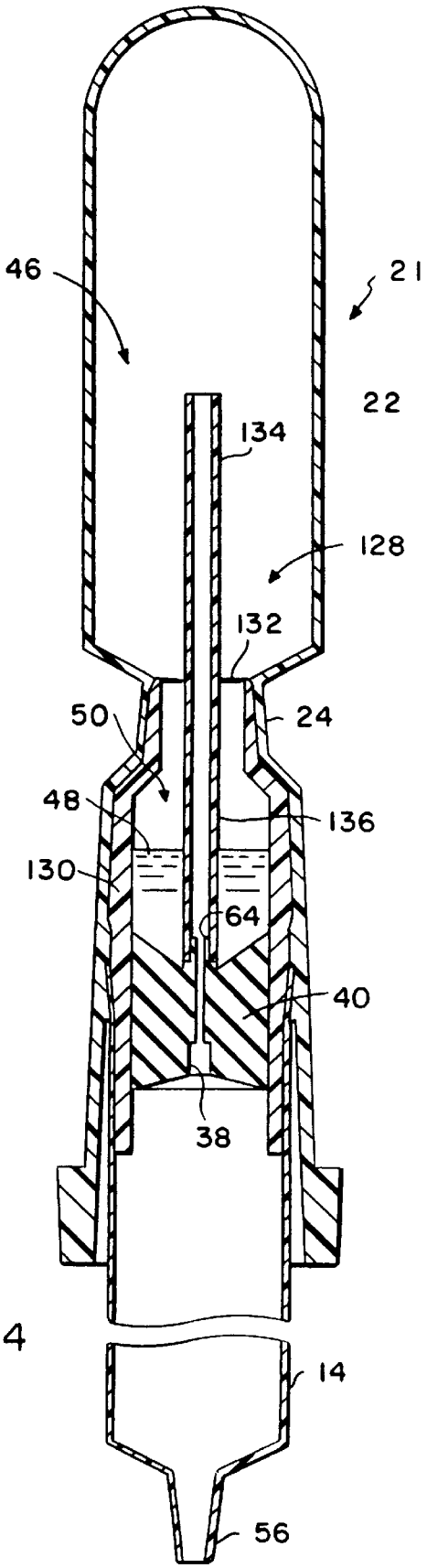
FIG. 14 is an enlarged fragmented vertical sectional view illustrating a modified test kit adapted for mixing a metered quantity of a liquid specimen or the like with a reagent.

In FIG. 13, another form of the invention is shown, wherein a modified seal plug 40' is provided in the form of a porous filter element which can be impregnated with the second reagent 148 in dried form. The porous seal plug 40' thus does not include a discrete outlet port 38 as previously shown and described, and a stem pin 36 for normally closing such outlet port is not required. However, the porous structure of the seal plug 40' provides a multiplicity of small outlet ports or flow paths. Bendover displacement of the upper squeeze bulb 22 and associated nib 34 is sufficient to rupture the membrane ring 32, thereby allowing the first reagent 44 to flow through the neck 24 into contact with an upstream side of the porous seal plug 40'. Subsequent squeezing of the squeeze bulb 22, as viewed in FIG. 13, pressure-drives the first reagent 44 through the porous seal plug 40', to accomplish the desired intermixing of the two reagents at the same time that the mixed reagents are pressure-dispensed to the specimen chamber 16 within the housing 14.

Another alternative form of the invention is shown in FIGS. 14–17. In this embodiment, a modified nib unit 128 is provided for slide fit installation into the outer cap 21 of the dispenser. The modified nib unit 128 includes a modified break-off nib 134 and associated stem pin 136 secured at the neck 24 to a liner sleeve 130 by a rupturable membrane ring 132. The nib 134 and stem pin 136 are provided in the form of an elongated open tube which projects from an upper end disposed within the first chamber 46 in the squeeze bulb 22, and a lower end sealingly fitted with the cylindrical protrusion 64 on the seal plug 40. A reagent 48 is provided in a metered quantity within the second chamber 50 defined between the membrane ring 132 and the seal plug 40. The first chamber 46 within the squeeze bulb 22 is initially empty.

Figure 15:
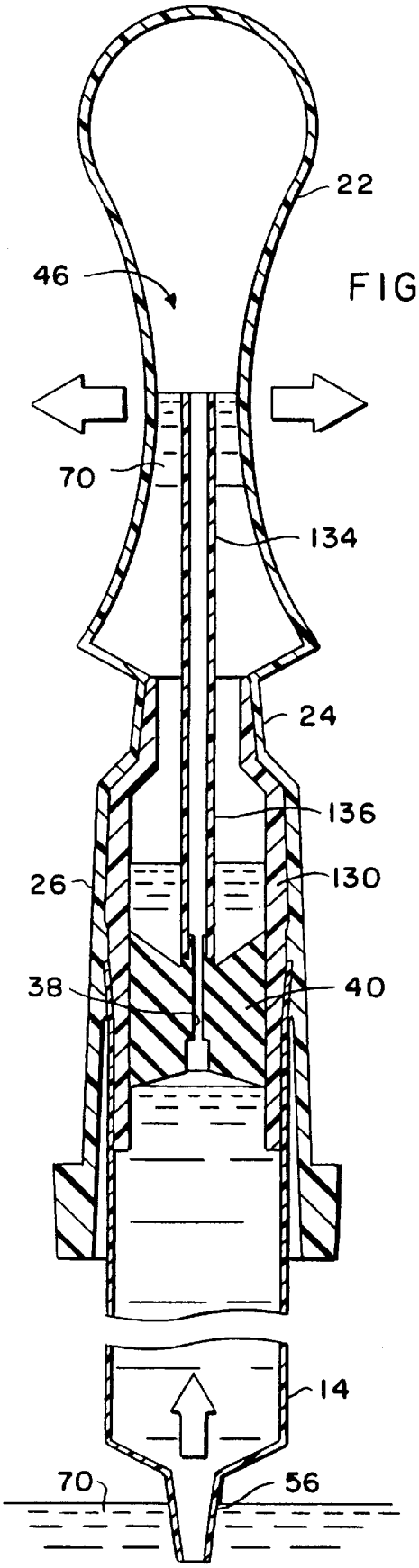
FIG. 15 is an enlarged fragmented vertical sectional view similar to FIG. 14, and illustrating manipulation of the test kit to draw in a metered volume of liquid specimen.

In the embodiment of FIGS. 14–17, the squeeze bulb 22 can be manipulated to draw a metered quantity of a selected liquid, for example, a urine specimen or other fluid specimen or reagent into the chamber 46 within the squeeze bulb 22. This step is illustrated in FIG. 15 by manually squeezing the bulb 22 to reduce the volumetric size of the chamber 46, at which time the dropper tip 56 on the housing 14 is placed into the liquid specimen 70 and the squeeze bulb 22 is released for vacuum-drawing of the liquid specimen 70 upwardly through the housing 14, the outlet port 38, and the inflow path formed in the hollow stem pin and nib 136, 134, into the upper chamber 46. A quantity of the liquid specimen 70 can be vacuum drawn into the chamber 46, until the liquid level in said chamber 46 reaches the top of the nib 134. Any excess liquid drawn into the chamber 46 will drain back through the nib and stem pin 134, 136, out of the chamber 46 when the squeeze bulb 22 is released. As a result, a metered quantity of the specimen 70, according to the height of the nib 134, may be drawn into the chamber 46.

Figure 16:
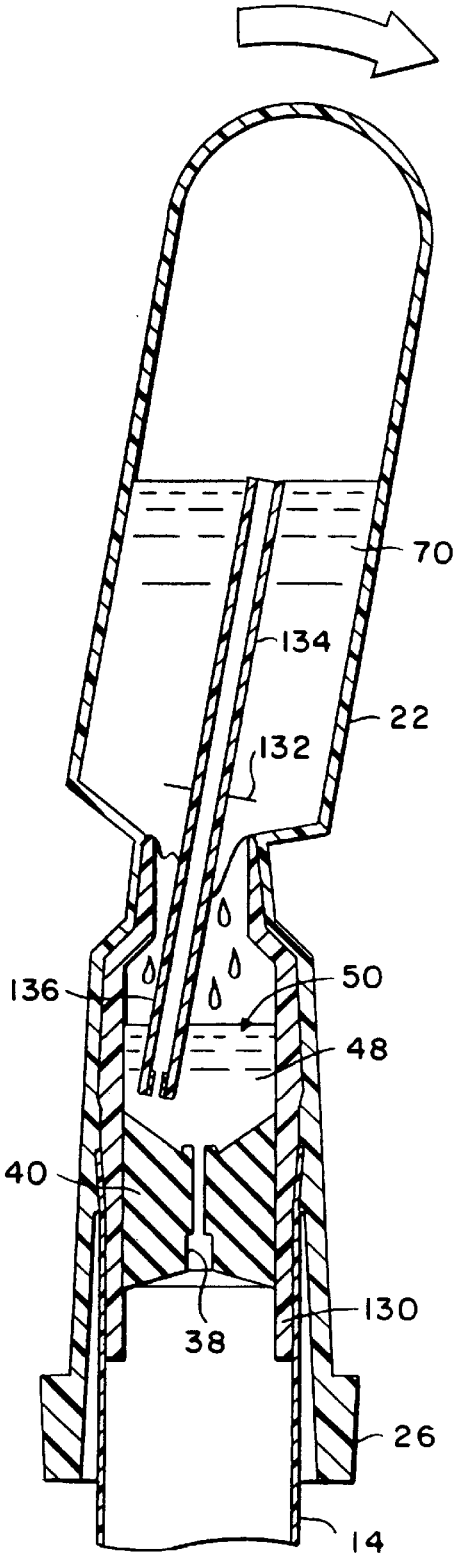
FIG. 16 is a fragmented vertical sectional view similar to FIG. 15, and illustrating deformation of the dispenser to sever the break-off nib.
Figure 17:
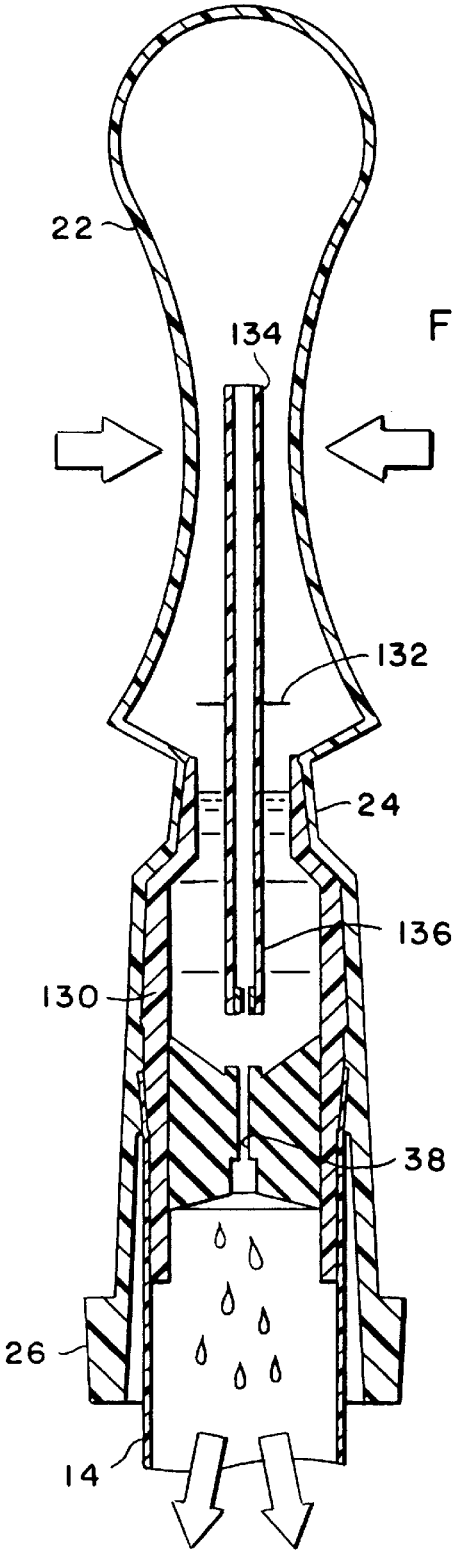
FIG. 17 is another fragmented vertical sectional view similar to FIG. 16, and illustrating subsequent deformation of the dispenser to express the mixed specimen and reagents.

FIG. 16 shows bendover displacement of the squeeze bulb 22 and the nib 134 to rupture the membrane ring 132, and thereby permit flow of the liquid specimen 70 into mixing relation with the reagent 48 in the second chamber 50. At the same time, or in a controlled sequence, the stem pin 136 is displaced from the seal plug 40 to open the outlet port 38. Subsequent squeezing of the squeeze bulb 22, as viewed in FIG. 17, is effective to pressure-dispense the mixed liquids, 70 and 48 through the outlet port 38 for further testing and analysis, as desired. Importantly, the entire collection and test process may be performed without directly exposing medical personnel to the collected specimen.

Figure 18:
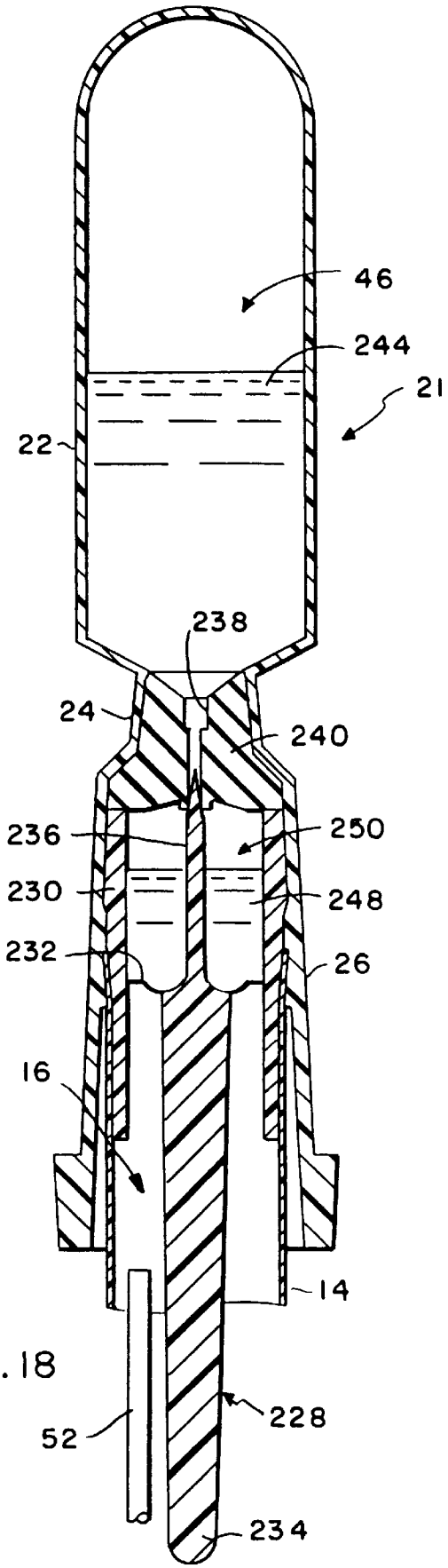
FIG. 18 is a fragmented vertical sectional view depicting still another alternative preferred form of the invention.

FIG. 18 shows a further modified form of the invention, wherein a nib unit 228 and associated seal plug 240 are generally inverted relative to the outer cap 21. As shown, the modified seal plug 240 has an outlet port 238 formed therein and is pressed-fitted into the neck region 24 of the outer cap, between the upper squeeze bulb 22 and the lower mounting sleeve 26. The nib unit 228 is then fitted into the mounting sleeve 26, with a liner sleeve 230 slidably fitted into the mounting sleeve 26. A rupturable membrane ring 232 closes a lower end of a second reagent chamber 250, with a break-off nib 234 projecting downwardly therefrom into the interior of the specimen chamber 16. A stem pin 236 projects upwardly from the membrane ring 232 for normally closing the outlet port 238. A first reagent 244 is contained within the chamber 46 of the squeeze bulb 22, and a second reagent 248 is contained within the second chamber 250. In the embodiment of FIG. 18, the dispenser 10 and/or the associated housing 14 are sufficiently deformable to permit angular bendover displacement of the break-off nib 234, for rupturing the membrane ring 32 and opening the outlet port 238, as previously described.

Figure 19:
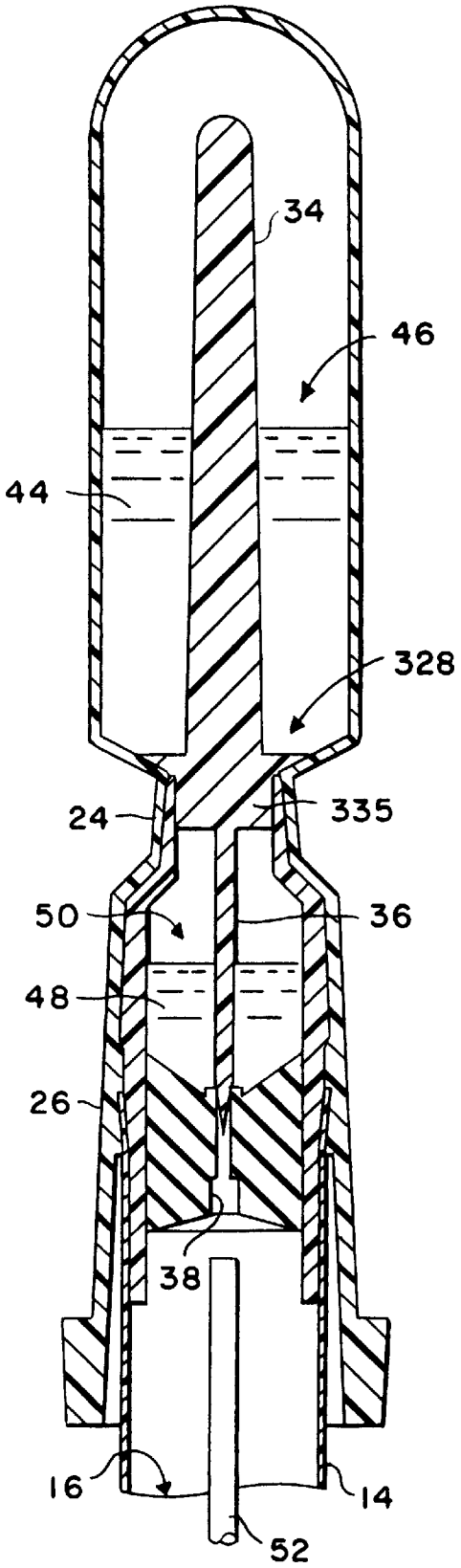
FIG. 19 is a fragmented vertical sectional view showing another alternative preferred form of the invention.

FIG. 19 shows another alternative form of the invention, generally similar to the embodiment of FIGS. 1–10, to include a modified nib unit 328 adapted to mix a pair of reagents 44 and 48 without inclusion of the frangible membrane ring. In this version, the nib unit 328 includes an upper nib 34 and a lower stem pin 36, with an enlarged central seal land 335 separating these components and initially positioned in sealed press-fit relation within the neck 24 of the liner sleeve 26. The seal land 335 thus provides a barrier between the two reagent chambers 46, 50 to maintain the two reagents 44,48 in separated relation. When reagent mixing is desired to perform a medical test, bendover displacement of the squeeze bulb 22 as previously described is effective to dislodge the seal land 335 from the neck 24 to allow the two reagents to flow together and mix. Such bendover displacement of the squeeze bulb 22 is also effective concurrently or sequentially to unseat the stem pin 36 from the outlet port 38 to permit delivery of the mixed reagents to the specimen chamber 16, again as previously described.

Figure 20:
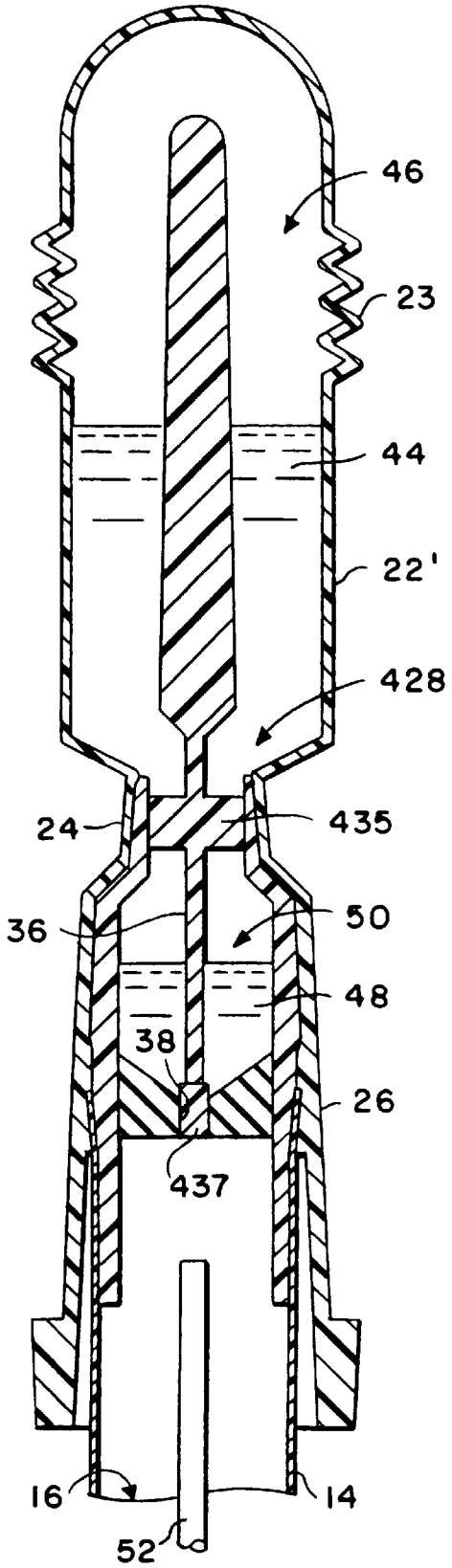
FIG. 20 is a fragmented vertical sectional view of still another alternative preferred form of the invention.

FIG. 20 illustrates a variation of the embodiment shown in FIG. 19, wherein a further modified nib unit 428 is used in combination with a modified squeeze bulb 22' which incorporates a corrugated segment 23 to permit longitudinal deformation thereof. In this version, the nib unit 428 has a first seal land 435 seated in the narrowed neck 24 of the liner sleeve 26 to provide a hermetically sealed barrier between the two reagents 44, 48 within the two chambers 46, 50. The stem pin 36 also carries a second seal land 437 normally seated within and closing the outlet port 38. The seal lands 435 and 437 are formed adjacent to nib and stem pin segments of narrowed cross sectional size, whereby longitudinal displacement of the nib unit 428 effectively unseats both seal lands for reagent mixing and dispensing to the specimen chamber 16. The corrugated segment 23 of the squeeze bulb 22' permits longitudinal displacement of the nib unit 428, by pushing or pulling motion.

Figure 21:
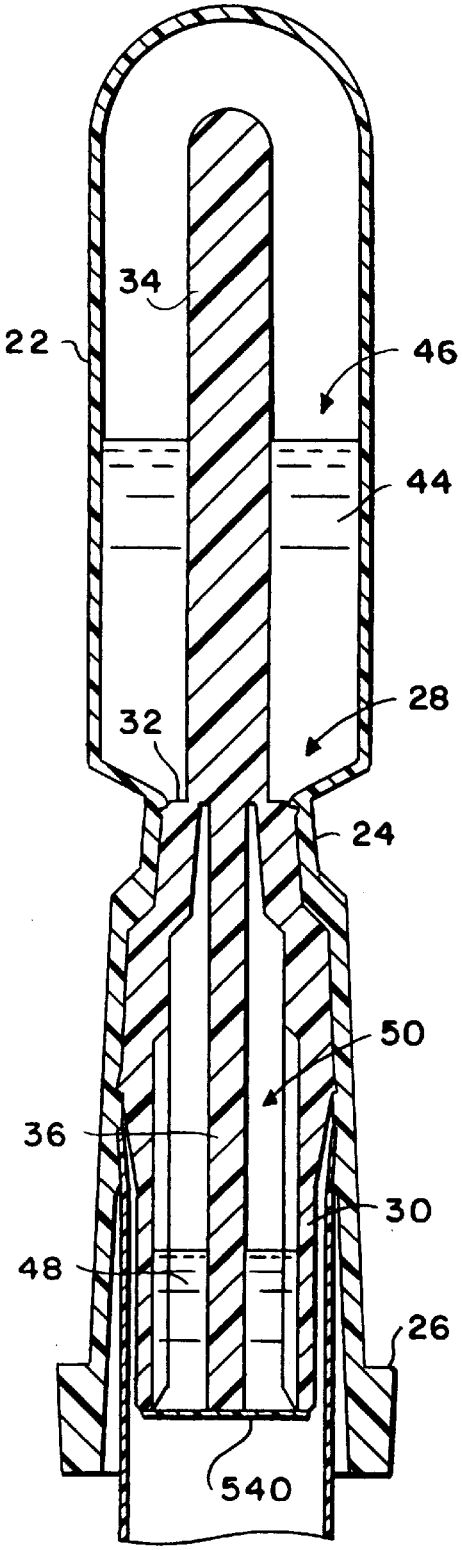
FIG. 21 is a fragmented vertical sectional view showing a further alternative preferred form of the invention.
Figure 22:
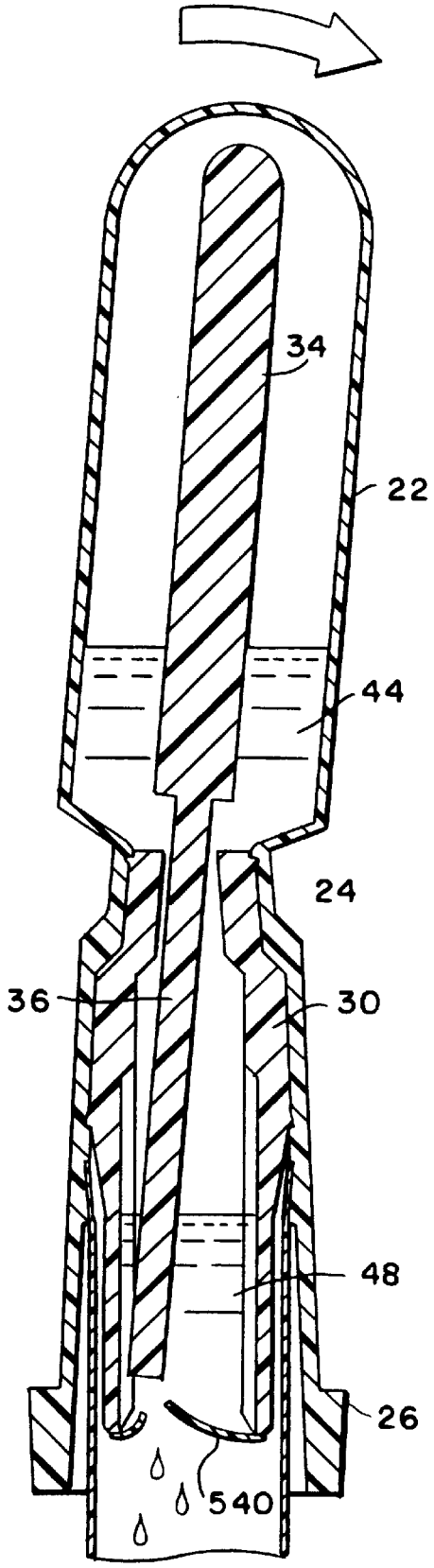
FIG. 22 is a fragmented vertical sectional view similar to FIG. 21, and illustrating deformation of the dispenser to mix and dispense reagents.

FIGS. 21 and 22 show a further alternative embodiment similar to the embodiment of FIGS. 1–10, but wherein the seal plug is substituted by a seal disk 540 of a rupturable or frangible foil material or the like. The seal disk 540 is attached as by heat sealing to the lower end of the stem pin 36 on the nib unit 28, and also to a lower margin of the liner sleeve 30. Accordingly, the seal disk 540 effectively closes and seals the lower end of the second reagent chamber 50 to sealingly retain the second reagent 48 therein.

When the squeeze bulb 22 is deformed as described in previous embodiments, the nib 34 breaks the membrane ring 32 to allow the reagents 44, 48 to mix together. Squeeze bulb deformation also displaces the lower end of the stem pin 36 sufficiently to deform and rupture the seal disk 540, as viewed in FIG. 22, to permit dispensing of the mixed reagents from the device.

The present invention thus provides a dual chemistry dispenser and related test unit or kit in a single compact and integrated package which permits safe and long term storage of multiple reagents for convenient mixing and dispensing at the time of performing a medical test or the like. The reagents, which may be unstable when mixed, can be retained in a stable manner and then mixed quickly and easily without measuring or direct contact by test personnel. A wide variety of tests can thus be performed. Moreover, the invention can be implemented in various nonmedical applications where it is desired to mix and dispense a mixed chemistry which is relatively unstable such that it is necessary or desirable to maintain the constituents separate until the time of use.

A variety of further modifications and improvements to the dual chemistry test unit of the present invention will be apparent to persons skilled in the art. For example, it will be recognized and understood that the dispenser depicted in any of the FIGS. 5–22 may be used as a separate dispense device as shown with respect to FIGS. 1–4. Accordingly, no limitation on the invention is intended by way of the foregoing description and accompanying drawings, except as set forth in the appended claims.

What is claimed is:

1. A reagent dispenser for dispensing multiple reagents, comprising:

a cap assembly defining a first chamber accommodating a first reagent, a second chamber accommodating a second reagent, and an outlet port communicating at least one of said first and second chambers to the exterior of said cap assembly; and closure means in said cap assembly for normally separating said chambers and for normally sealing said outlet port;

said cap assembly being sufficiently deformable to open said closure means to permit flow of the first and second reagents through said outlet port to the exterior of said cap assembly.

2. The reagent dispenser of claim 1 wherein said cap assembly is manually deformable to open said closure means.

3. The reagent dispenser of claim 1 wherein said closure means is mounted within said cap assembly.

4. The reagent dispenser of claim 1 wherein said cap assembly is formed from a resilient plastic material.

5. The reagent dispenser of claim 4 wherein said cap assembly is formed from a resilient plastic material that is at least partially transparent.

6. The reagent dispenser of claim 1 further including a passage connecting said first chamber to said second chamber, said closure means being sufficiently deformable to pen said passage.

7. The reagent dispenser of claim 6 wherein said closure means includes a frangible ring for normally sealing and closing said passage, and an elongated nib projecting from said frangible ring into one of said first and second chambers, said cap assembly being sufficiently deformable to bend said nib relative to said frangible ring to rupture said ring and thereby open said passage.

8. The reagent dispenser of claim 7 wherein said nib projects from said frangible ring into said first chamber.

9. The reagent dispenser of claim 7 wherein said closure means further includes a stem pin formed as an extension of said nib, said stem pin having a tip seated within said outlet port for normally sealing said outlet port, said cap assembly being sufficiently deformable to dislodge said stem pin from said outlet port and thereby open said outlet port.

10. The reagent dispenser of claim 6 wherein said closure means includes a frangible ring for normally sealing and closing said outlet port, an elongated nib projecting from said frangible ring, and a stem pin formed as an extension of said nib and having a tip seated within said passage for normally sealing and closing said passage, said cap assembly being sufficiently deformable to bend said nib relative to said frangible ring to rupture said ring and thereby open said outlet port, and further to dislodge said stem pin from said passage and thereby open said passage.

11. The reagent dispenser of claim 6 wherein said closure means includes a seal land press-fit into said passage for normally sealing and closing said passage, and an elongated nib projecting from said seal land into one of said first and second chambers, said cap assembly being sufficiently deformable to bend said nib relative to said seal land to dislodge said seal land from said passage and thereby open said passage.

12. The reagent dispenser of claim 11 wherein said closure means further includes a stem pin formed as an extension of said nib, said stem pin having a tip seated within said outlet port for normally closing and sealing said outlet port, said cap assembly being sufficiently deformable to dislodge said stem pin from said outlet port and thereby open said outlet port.

13. The reagent dispenser of claim 6 wherein said closure means includes a first seal land press-fit into said passage for normally sealing and closing said passage, and a second seal land press-fit into said outlet port for normally sealing and closing said outlet port, said cap assembly being sufficiently deformable relative to said closure means to dislodge said first and second seal lands respectively from said passage and said outlet port to respectively open said passage and said outlet port.

14. The reagent dispenser of claim 6 wherein said closure means comprises a first frangible member for normally closing said passage, a second frangible member for normally closing said outlet port, and nib means connected to said first and second frangible members, said cap assembly being sufficiently deformable to displace said nib means to rupture said first and second frangible members.

15. The reagent dispenser of claim 1 wherein said cap assembly includes a deformable squeeze bulb having at least a portion of said closure means therein.

16. The dual chemistry dispenser of claim 1 wherein said cap assembly includes a deformable corrugated segment having at least a portion of said closure means therein.

17. The reagent dispenser of claim 1 wherein said closure means includes a hollow nib extending from said first chamber and through said second chamber and said outlet port to the exterior of said cap assembly, said hollow nib defining an inflow path for fluid flow into said first chamber, said cap assembly being sufficiently deformable to vacuum draw a fluid through the inflow path into said first chamber.

18. The reagent dispenser of claim 1 further including a hollow tubular housing having an open rear end, said cap assembly being removably mounted on said open rear end of said housing to cooperate with said housing to define a specimen chamber.

19. The reagent dispenser of claim 18 wherein said housing has a dropper tip at a front end thereof.

20. The reagent dispenser of claim 18 wherein said housing has a porous filter plug disposed therein, said filter plug being impregnated with a third reagent.

21. A reagent test kit, comprising:

a cap assembly defining a first chamber for receiving a first reagent, a second chamber for receiving a second reagent, a passage connecting said first chamber to said second chamber, and an outlet port communicating said second chamber to the exterior of said cap assembly;

closure means for normally closing and sealing said passage to maintain said first and second chambers sealed from each other, and for normally closing and sealing said outlet port; and a hollow housing having an open rear end and adapted for assembly with said cap assembly for cooperation therewith to define a specimen chamber, said second chamber of said cap assembly being positioned with said outlet port for flow communication with said specimen chamber when said cap assembly and said housing are assembled together and when said outlet port is opened by said closure means;

at least one of said cap assembly and said housing being sufficiently deformable to displace said closure means relative to said cap assembly to open said passage and permit mixing of the first and second reagents, and to open said outlet port for flow of mixed reagents from said second chamber to said specimen chamber.

22. The reagent test kit of claim 21 wherein said closure means is mounted within said cap assembly.

23. The reagent test kit of claim 21 wherein said cap assembly is formed from a resilient plastic material.

24. The reagent test kit of claim 23 wherein said cap assembly is formed from a resilient plastic material that is at least partially transparent.

25. The reagent test kit of claim 21 wherein said closure means includes a frangible ring for normally sealing and closing said passage, and an elongated nib projecting from said frangible ring into one of said first and second chambers, said cap assembly being sufficiently deformable to bend said nib relative to said frangible ring to rupture said ring and thereby open said passage.

26. The reagent test kit of claim 25 wherein said nib projects from said frangible ring into said first chamber.

27. The reagent test kit of claim 25 including a porous plug mounted within said second chamber, said porous plug being adapted to be impregnated with the second reagent.

28. The reagent test kit of claim 25 wherein said cap assembly further includes a seal member having said outlet port formed therein for passage of the mixed reagents from said second chamber to said specimen chamber, said closure means further including a stem pin formed as an extension of said nib, said stem pin having a tip seated for normally closing and sealing said outlet port, said cap assembly being sufficiently deformable to displace said stem pin relative to said outlet port and thereby open said outlet port.

29. The reagent test kit of claim 21 wherein said cap assembly further includes a seal member having said outlet port formed therein for passage of the mixed reagents from said second chamber to said specimen chamber, said closure means comprising includes a frangible ring for normally sealing and closing said outlet port, an elongated nib projecting from said frangible ring, and a stem pin formed as an extension of said nib and having a tip seated within said passage for normally sealing and closing said passage, said cap assembly being sufficiently deformable to bend said nib relative to said frangible ring to rupture said ring and thereby open said outlet port, and further to dislodge said stem pin from said passage and thereby open said passage.

30. The reagent test kit of claim 21 wherein said closure means includes a seal land press-fit into said passage for normally sealing and closing said passage, and an elongated nib projecting from said seal land into one of said first and second chambers, said cap assembly being sufficiently deformable to bend said nib relative to said seal land to dislodge said seal land from said passage and thereby open said passage.

31. The reagent test kit of claim 21 wherein said cap assembly further includes a seal member having said outlet port formed therein for passage of the mixed reagents from said second chamber to said specimen chamber, said closure means comprising a first seal land press-fit into said passage for normally sealing and closing said passage, and a second seal land press-fit into said outlet port for normally sealing and closing said outlet port, said cap assembly being sufficiently deformable relative to said closure means to dislodge said first and second seal lands respectively from said passage and said outlet port to respectively open said passage and said outlet port.

32. The reagent test kit of claim 21 wherein said cap assembly includes a deformable squeeze bulb having at least a portion of said closure means therein.

33. The reagent test kit of claim 21 wherein said cap assembly includes a deformable corrugated segment having at least a portion of said closure means therein.

34. The reagent test kit of claim 21 wherein said housing has a dropper tip at a front end thereof.

35. The reagent test kit of claim 21 wherein said housing has a porous filter plug disposed therein, said filter plug being impregnated with a third reagent.

36. A multichamber dispenser, comprising:

a cap assembly defining a first chamber for receiving a first agent, a second chamber for receiving a second . agent, and a passage interconnecting said first and second chambers; and closure means for normally closing and sealing said passage to maintain said first and second chambers sealed from each other, said closure means defining a fluid inflow path extending from the exterior of said cap assembly and through said second chamber into said first chamber;

said cap assembly being sufficiently deformable to permit vacuum drawing of the first agent through said fluid inflow path into said first chamber, and cap assembly further being sufficiently deformable to displace said closure means relative to said cap assembly to open said passage and permit mixing of the first agent with the second agent in said second chamber, said cap assembly further includes a seal member having an outlet port formed therein for passage of the mixed first and second agents from said second chamber to the exterior of the cap assembly, said closure means extending through said outlet port for normally closing and sealing said second chamber from the exterior of said cap assembly, said cap assembly being sufficiently deformable to displace said closure means relative to said seal member to open said outlet port.

37. The multichamber dispenser of claim 36 wherein said closure means projects a predetermined distance into said first chamber to permit vacuum drawing of a metered amount of the first agent.

38. The multichamber dispenser of claim 37 further including a metered quantity of the second agent in said second chamber.

39. A reagent dispenser for dispensing multiple reagents, comprising:

a cap assembly defining a first chamber for receiving a first reagent, a second chamber for receiving a second reagent, a passage interconnecting said first and second chambers, and means defining an outlet port leading from one of said first and second chambers to the exterior of the dispenser; and closure means for normally closing and sealing said passage to maintain said first and second chambers sealed from each other, and for normally closing and sealing said outlet port;

said cap assembly being sufficiently deformable to displace said closure means relative to said cap assembly to open said passage and permit mixing of the first and second reagents, and further to open said outlet port to permit the mixed first and second reagents to be expressed through said outlet port to the exterior of the dispenser.

40. The reagent dispenser of claim 39 wherein said cap assembly is sufficiently deformable to express the first reagent from said first chamber for flow through said passage to contact said second reagent within said second chamber.

41. A handheld dispenser for storing first and second reagents and actuatable by finger pressure to dispense the reagents, said dispenser comprising:

a hollow housing enclosing an internal volume, said housing including a peripheral wall with at least a portion thereof deformable by finger pressure from a normal nondeformed position to a deformed position, said housing further defining an outlet port communicating with said internal volume;

a closure member sealing the outlet port when said deformable housing portion is in the normal position and opening said outlet port when said deformable housing portion is in the deformed position; and a partition separating said internal volume into first and second chambers when said deformable housing portion is in the normal position and communicating said first and second chambers when said deformable housing portion is in the deformed position.

42. The dispenser of claim 41 wherein said closure member and said partition are connected to each other.

43. The dispenser of claim 41 wherein said closure member and said partition are mounted within said housing.

44. The dispenser of claim 42 wherein said partition is mounted within said housing.

45. The dispenser of claim 41 wherein said housing is formed from a resilient plastic material.

46. The dispenser of claim 45 wherein said housing is at least partially transparent.

47. The dispenser of claim 41 wherein said partition includes a frangible ring for normally separating said internal volume into said first and second chambers, and an elongated nib projecting from said frangible ring into one of said first and second chambers, said housing being sufficiently deformable to bend said nib relative to said frangible ring to rupture said ring and thereby communicate said first and second chambers.

48. The dispenser of claim 47 wherein said closure member comprises a stem pin formed as an extension of said nib, said stem pin including means for closing the outlet port when said deformable housing portion is in the normal position, said housing being sufficiently deformable to displace said stem pin relative to said outlet port to open the outlet port.

* * * * *

UNITED STATES PATENT AND TRADEMARK OFFICE

CERTIFICATE OF CORRECTION

PATENT NO. : 5,879,635

DATED : March 9, 1999

INVENTOR(S) : Frederic L. Nason

It is certified that error appears in the above-identified patent and that said Letters Patent is hereby corrected as shown below:

In column 10, line 31, delete "pen" and insert --open--.

In column 11, line 24, delete "dual chemistry" and insert --reagent--.

Signed and Sealed this

Twentieth Day of July, 1999

*Attest:*

*Attesting Officer*

Q. TODD DICKINSON

*Acting Commissioner of Patents and Trademarks*